US007744175B2

(12) United States Patent
Peng et al.

(10) Patent No.: US 7,744,175 B2
(45) Date of Patent: Jun. 29, 2010

(54) SLIDE RAIL ASSEMBLY

(75) Inventors: Wen-Tang Peng, Taipei Hsien (TW); Mo-Ming Yu, Shenzhen (CN); Zong-Yuan Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 420 days.

(21) Appl. No.: 11/923,660

(22) Filed: Oct. 25, 2007

(65) Prior Publication Data

US 2008/0164795 A1 Jul. 10, 2008

(30) Foreign Application Priority Data

Jan. 10, 2007 (CN) ..... 2007 2 0200004 U

(51) Int. Cl.
*A47B 88/00* (2006.01)

(52) U.S. Cl. ..... 312/333; 312/334.46

(58) Field of Classification Search .....
312/334.44–334.47, 333, 334.7; 384/21
See application file for complete search history.

(56) References Cited

U.S. PATENT DOCUMENTS

| | | | | |
|---|---|---|---|---|
| 6,979,067 | B2 * | 12/2005 | Yang | 312/334.46 |
| 2005/0088069 | A1 * | 4/2005 | Greenwald et al. | 312/333 |
| 2007/0170830 | A1 * | 7/2007 | Huang | 312/334.47 |
| 2009/0058241 | A1 * | 3/2009 | Huang | 312/334.8 |

* cited by examiner

*Primary Examiner*—Janet M Wilkens
(74) *Attorney, Agent, or Firm*—Frank R. Niranjan

(57) ABSTRACT

An exemplary slide rail assembly includes a first rail with a protrusion, a second rail, a releasing member, a pair of push buttons, a first latch member, and a second latch member. The releasing member is slidably attached to the second rail and includes a pair of openings for receiving the buttons, and two angular driving edges. The second rail includes a pair of resilient tabs detachably and respectively engaging with the buttons and the releasing member. The first and second latch members are pivotably attached to the second rail. The first latch member includes a post extending therefrom to be selectively driven by the driving edges of the releasing member. The buttons are actuated to release the releasing member from the resilient tabs and move the releasing member to drive the first latch member and the second latch member to disengage the protrusion of the first rail.

15 Claims, 9 Drawing Sheets

SLIDE RAIL ASSEMBLY

BACKGROUND

1. Field of the Invention

The present invention relates to a slide rail assembly.

2. Description of related art

Slide rails are used in a variety of applications, including business furniture, kitchen drawers, electronic racks, and copiers. One type of slide rail is a telescopic slide rail. Telescopic slide rails often include two, three, four or more telescoping members. The shape of a slide rail, and the individual members, are determined by design needs. The slides can be frictional, with lubricated members rubbing against each other, or a slide assembly may include roller or ball bearings for easier movement. The members in such assemblies tend to be C-shaped in cross-section.

A conventional three-section slide rail assembly for a drawer includes a first rail (e.g. outer slide rail), a second rail (e.g. middle slide rail), and a third rail (e.g. inner slide rail). A ball rail is sandwiched between any two of the first rail, the second rail, and the third rail to provide a smooth sliding movement. Moreover, the third rail and the second rail mount a retaining member and a stop member respectively to prevent the slide rails extending too far. The retaining member is attached to an inner surface of the third rail, and provided with an inclined wall. The stop member is mounted to a front end of the second rail, and provided with a protrusion. To prevent users from drawing the third rail out too far from the second rail, the protrusion of the stop member engages with the inclined wall of the retaining member.

Accordingly, a releasing member is often configured to the rail assembly. The releasing member is moved to drive the retaining member to release the protrusion of the stop member. However, the releasing member may be moved by accident, leading to an unwanted release of the rail assembly. Therefore, the releasing member is unreliable.

Consequently, what is required is a slide rail assembly which can reliably release the rail assembly.

SUMMARY

In one embodiment, a slide rail assembly includes a first rail with a protrusion, a second rail, a releasing member, a pair of push buttons, a first latch member, and a second latch member. The releasing member is slidably attached to the second rail and includes a pair of openings for receiving the buttons, and two angular driving edges. The second rail includes a pair of resilient tabs detachably and respectively engaging with the buttons and the releasing member. The first and second latch members are pivotably attached to the second rail. The first latch member includes a post extending therefrom to be selectively driven by the driving edges of the releasing member. The buttons are actuated to release the releasing member from the resilient tabs and move the releasing member to drive the first latch member and the second latch member to disengage the protrusion of the first rail.

Other advantages and novel features of the present invention will become more apparent from the following detailed description of preferred embodiment when taken in conjunction with the accompanying drawings, in which:

DETAILED DESCRIPTION OF THE INVENTION

Figure 1:
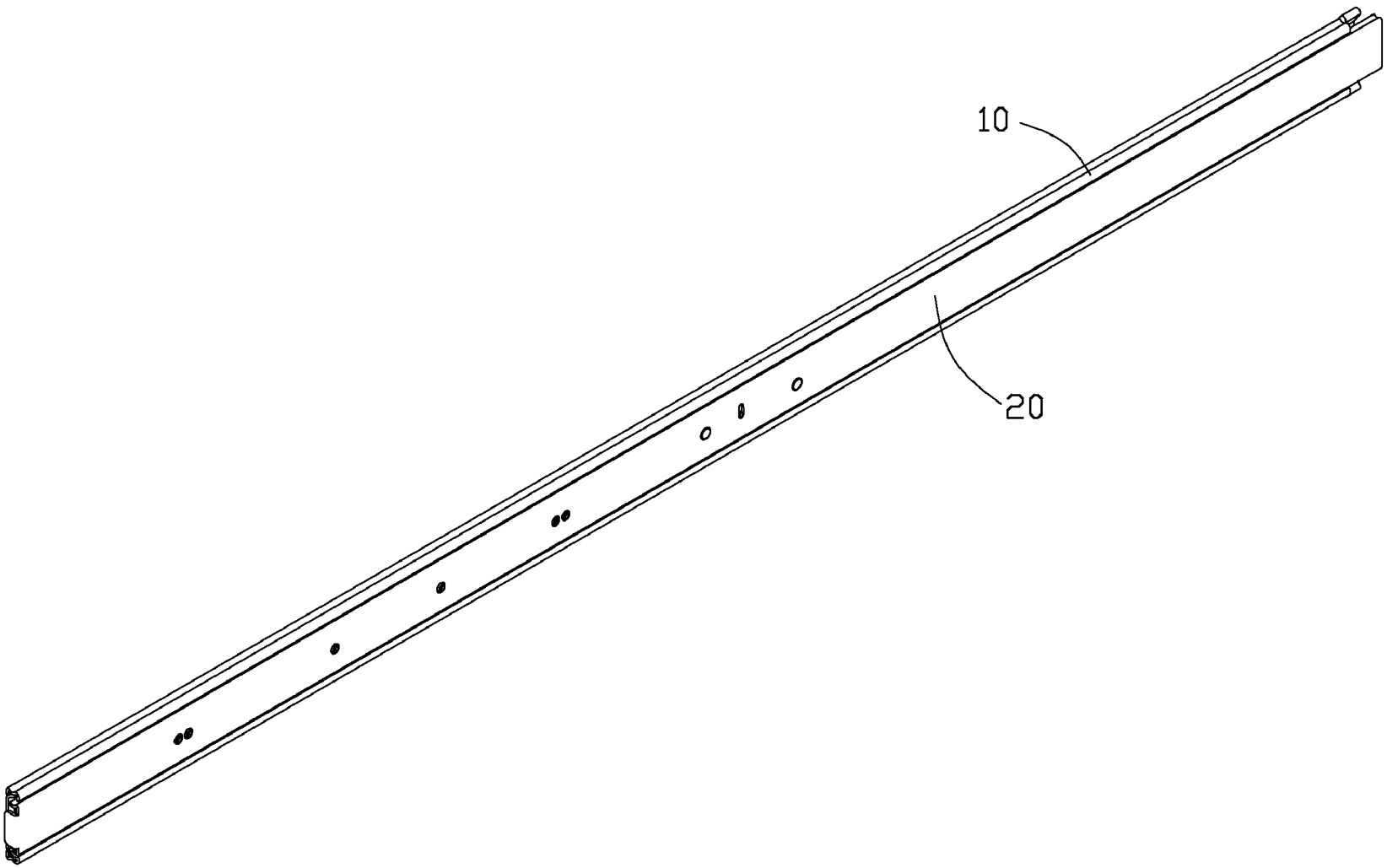
FIG. 1 is an assembled, isometric view of a slide rail assembly according to an embodiment of the present invention.
Figure 2:
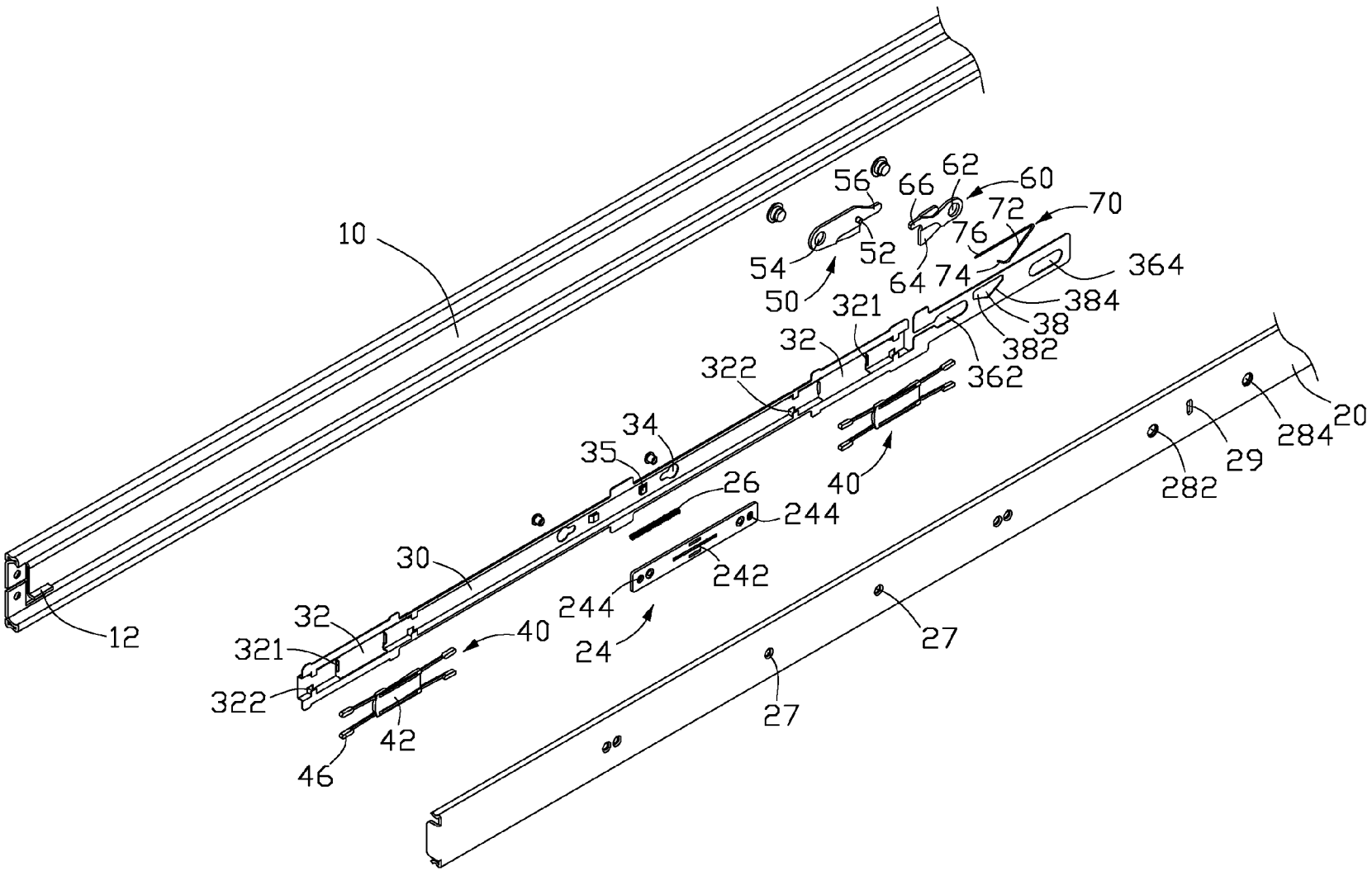
FIG. 2 is an exploded, isometric view of the slide rail assembly of FIG. 1, the slide rail assembly including a first rail, a second rail, a pair of buttons, a release member, a fixing board, a resilient member, a stop member, a retaining member, and a clip.

Referring to FIGS. 1 and 2, in an embodiment of the invention, a slide rail assembly includes a first rail 10, a second rail 20 slidably coupled to the first rail 10, a release member 30, a pair of push buttons 40, a fixing board 24, a coiled spring 26, a resilient clip 70, a first latch member 50, and a second latch member 60.

Each of the first rail 10 and the second rail 20 has a pair of flanges extending from two elongated sides thereof. The first rail 10 has a protrusion 12 extending from one end thereof.

Figure 3:
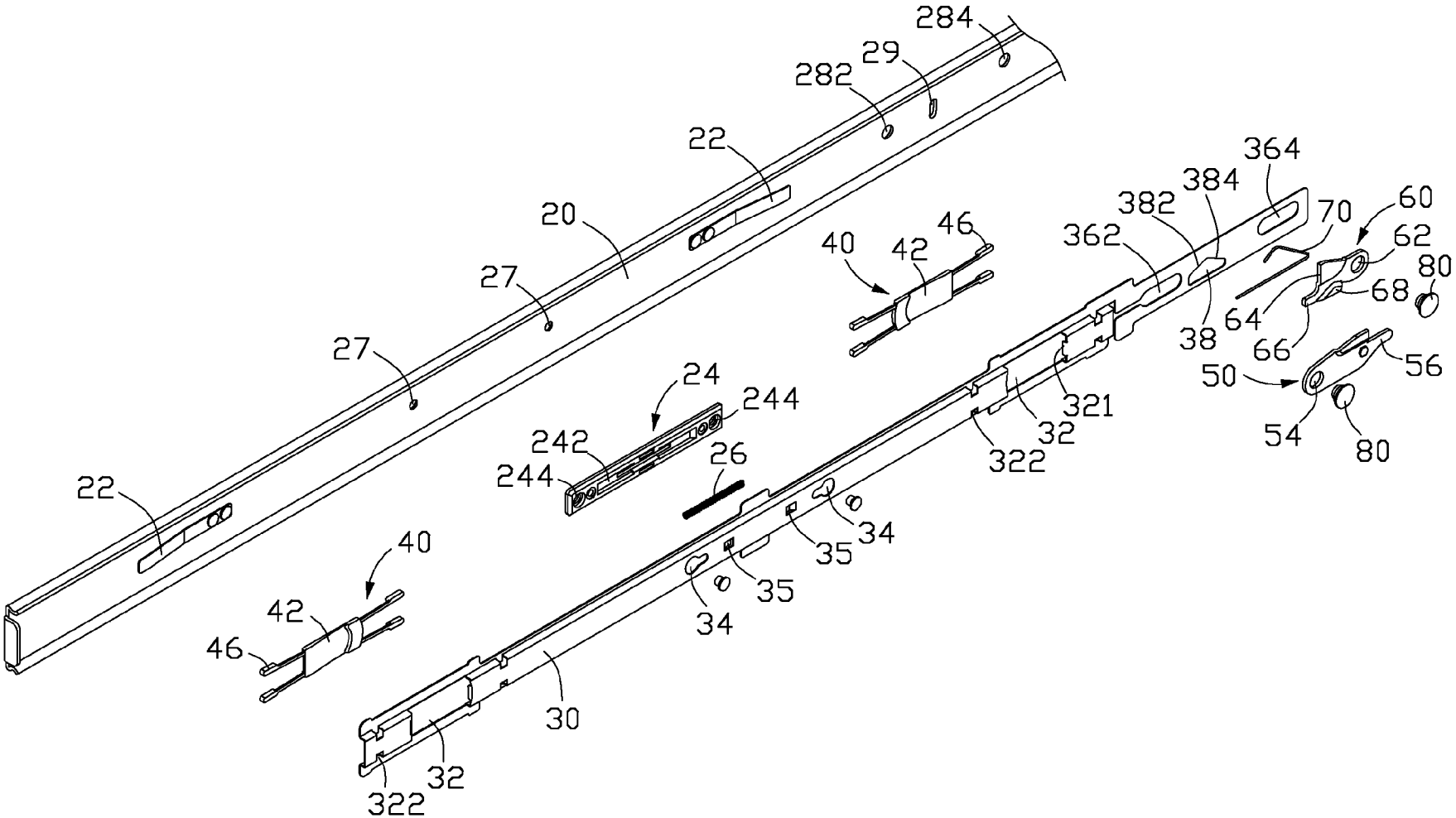
FIG. 3 is similar to FIG. 2, without the first rail and viewed from another aspect.

Referring also to FIG. 3, the second rail 20 includes a pair of resilient tabs 22 attached on a same surface thereon extending opposite from each other, a pair of fixing holes 27 defined between the resilient tabs 22, a first mounting hole 282 and a second mounting hole 284 defined near one resilient tab 22, and a slanting slit 29 defined between the first and second mounting holes 282, 284.

The fixing board 24 includes a long channel 242 for receiving the coiled spring 26 therein, and a pair of through holes 244 defined beside two ends of the long channel 242, respectively.

Figure 6:
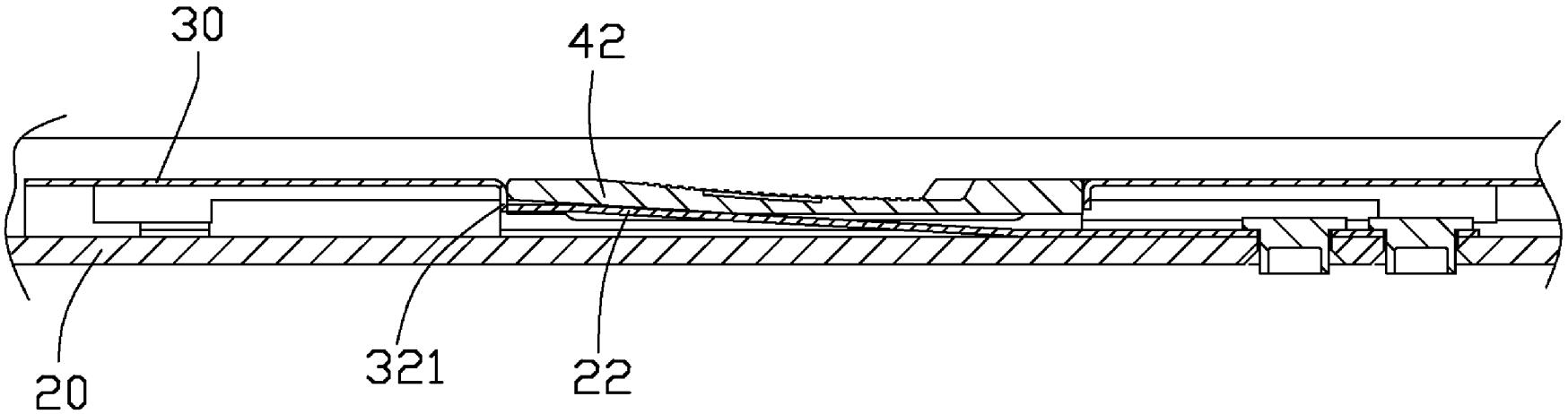
FIG. 6 is a cross-sectional view along line VI-VI of FIG. 5.

The release member 30 is elongated, and includes a pair of rectangular openings 32 defined therein for respectively retaining the push buttons 40 therein, a pair of key-shaped holes 34 opposite to each other defined between the openings 32, a pair of hooks 35 extending toward each other between the key-shaped holes 34, a pair of grooves 362, 364 defined in a right end portion thereof, and a triangular slot 38 defined between the grooves 362, 364. Four apertures 322 are defined in the release member 30 around each of the rectangular openings 32. Referring also to FIG. 6, a pair of tabs 321 extends perpendicularly from two end edges of each of the rectangular openings 32 of the release member 30. The triangular slot 38 includes a pair of driving edges 382, 384.

Figure 4:
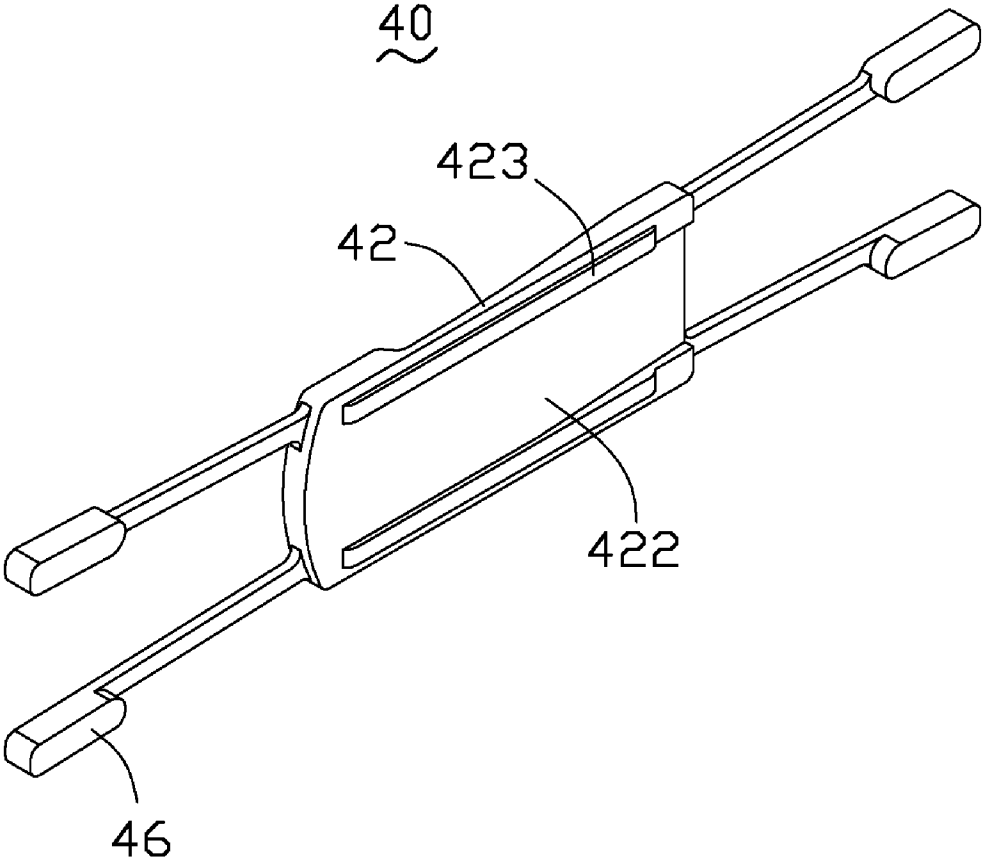
FIG. 4 is an enlarged view of one of the buttons of FIG. 2.

Referring also to FIG. 4, each of the push buttons 40 includes a main body 42, and four feet 46 respectively extending from four corners of the main body 42 to engage in the corresponding apertures 322 of the releasing member 30. The main body 42 includes a protrusion in an outside surface thereof for ease of operation, and a pair of spaced ribs 423 extending from an inside surface 422 thereof.

Referring to FIG. 2, the first latch member 50 includes a post 52 extending from a middle portion thereof, a first pivoting hole 54 defined in a left end portion thereof, and a driving portion 56 extending from a right end portion thereof. The driving portion 56 has an arc-shaped engaging surface at the free end thereof.

The second latch member 60 includes a second pivoting hole 62 defined in an end portion thereof, and a stop portion 64 and a driven portion 66 extending from the opposite end portion thereof. The stop portion 64 includes a stop surface adjacent to the driven portion 66. Referring to FIG. 3, a catch 68 extends from a lower edge of the driven portion 66.

The resilient clip 70 includes a main portion 72, and a first arm 74 and a second arm 76 extending angled from two ends of the main portion 72. In this embodiment, the clip 70 is preferably made from bent resilient steel wire.

Figure 5:
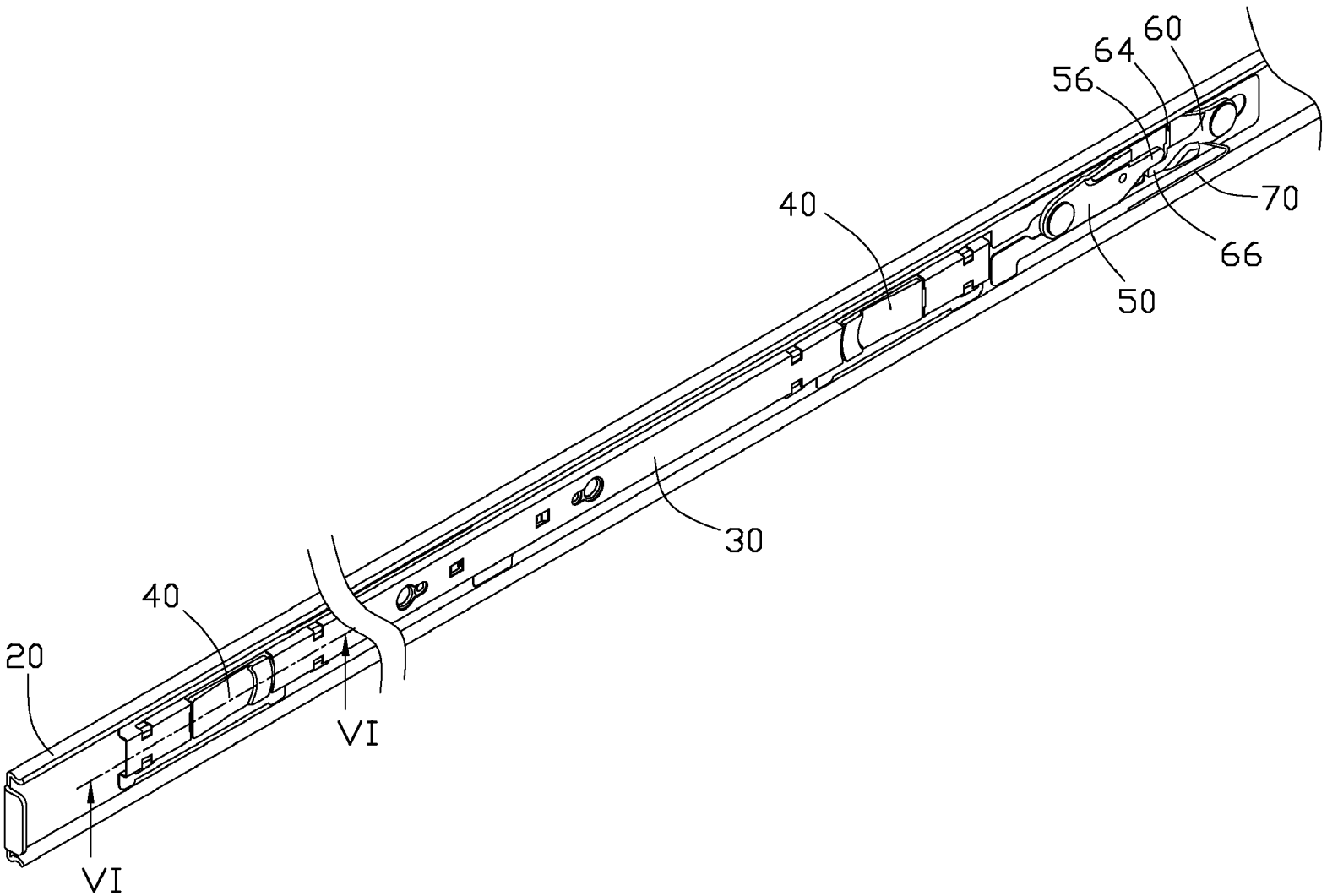
FIG. 5 is an assembled view of the slide rail assembly of FIG. 3.
Figure 7:
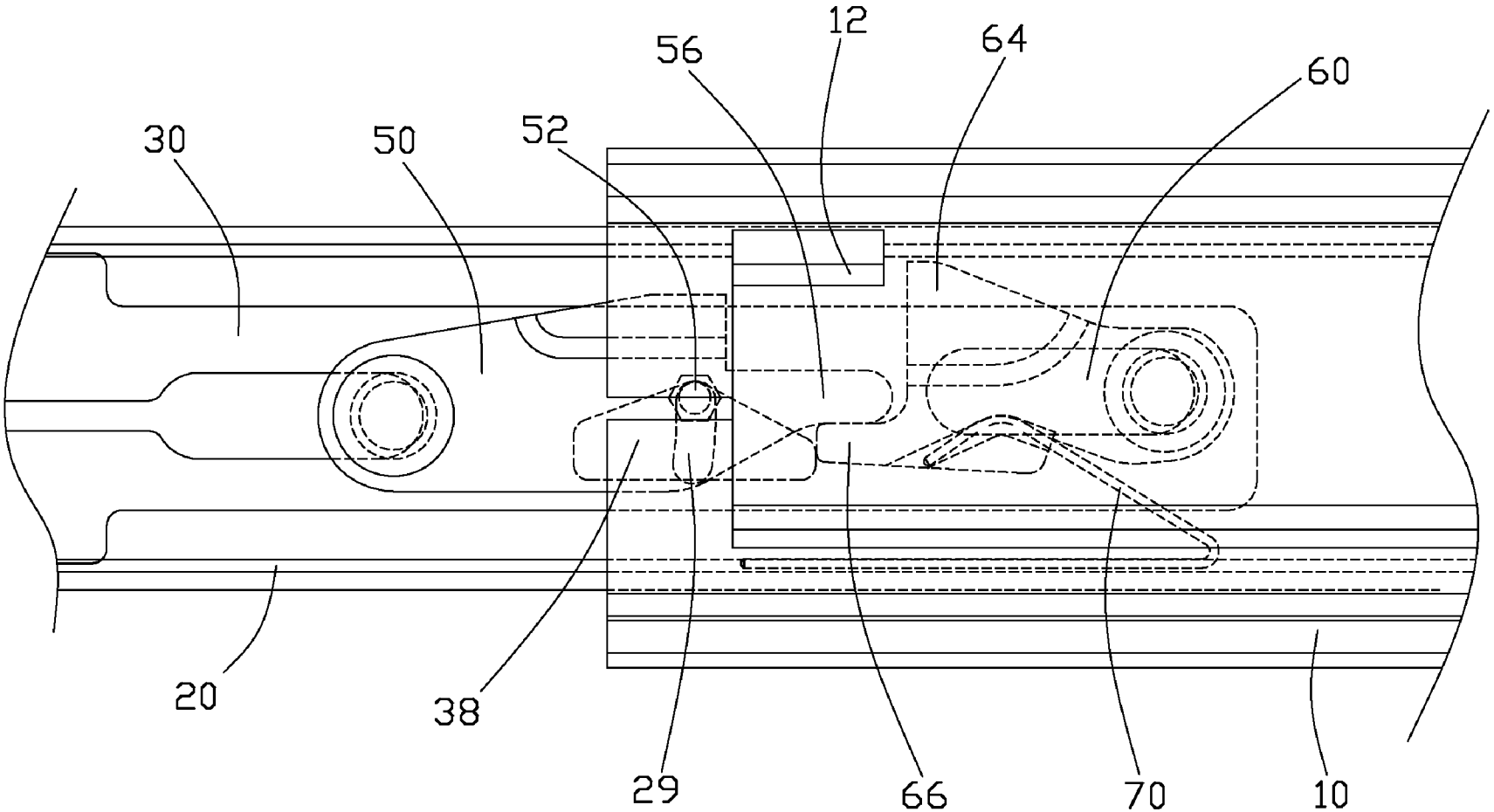
FIGS. 7-9 are lateral views of the slide rail assembly of FIG. 1, showing three using states, respectively.

Referring also to FIGS. 4 and 5, in assembly, the push buttons 40 are attached to the releasing member 30, with the feet 46 thereof engaging in the apertures 322 of the releasing member 30 and the main body 42 thereof engaging in the openings 32 of the releasing member 30. The releasing member 30 is slidably attached to the second rail 20. The coiled spring 26 is received in the long channel 242 of the fixing board 24. A pair of fasteners slidably extends through the key-shaped holes 34 of the releasing member 30 and the through holes 244 of the fixing board 24 to engage in the fixing holes 27 of the second rail 20 respectively. The hooks 35 of the releasing member 30 extend into the long channel 242 of the fixing board 24 and respectively press two ends of the coiled spring 26. Referring to FIG. 5, the tilted free end of each of the resilient tabs 22 of the second rail 20 is received in a space defined between the ribs 423 of the corresponding push button 40 and abuts against the inside surface 422 of the corresponding push button 40, respectively. Distal ends of the resilient tabs 22 respectively abut against the tabs 321 of the releasing member 30 to prevent the releasing member 30 being moved back and forth. The first and second latch members 50, 60 are pivotably attached to the second rail 20 via a pair of mounting members 80 extending through the first and second pivoting holes 54, 62 and slidably received in the pair of elongated grooves 362, 364 of the releasing member 30 to engage in the first and second mounting holes 282, 284 of the second rail 20, respectively. The post 52 of the first latch member 50 extends through the triangular slot 38 of the releasing member 30 to be received in the slanting slits 29 of the second rail 20. The first arm 74 of the resilient clip 70 is held by the catch 68 of the second latch member 60 and the second arm 76 abuts against one corresponding flange of the second rail 20. The first rail 10 is attached to the second rail 20 and the protrusion 1 2 of the first rail 10 is blocked by the stop surface of the stop portion 64 of the second latch 60 (see FIG. 7).

Figure 8:
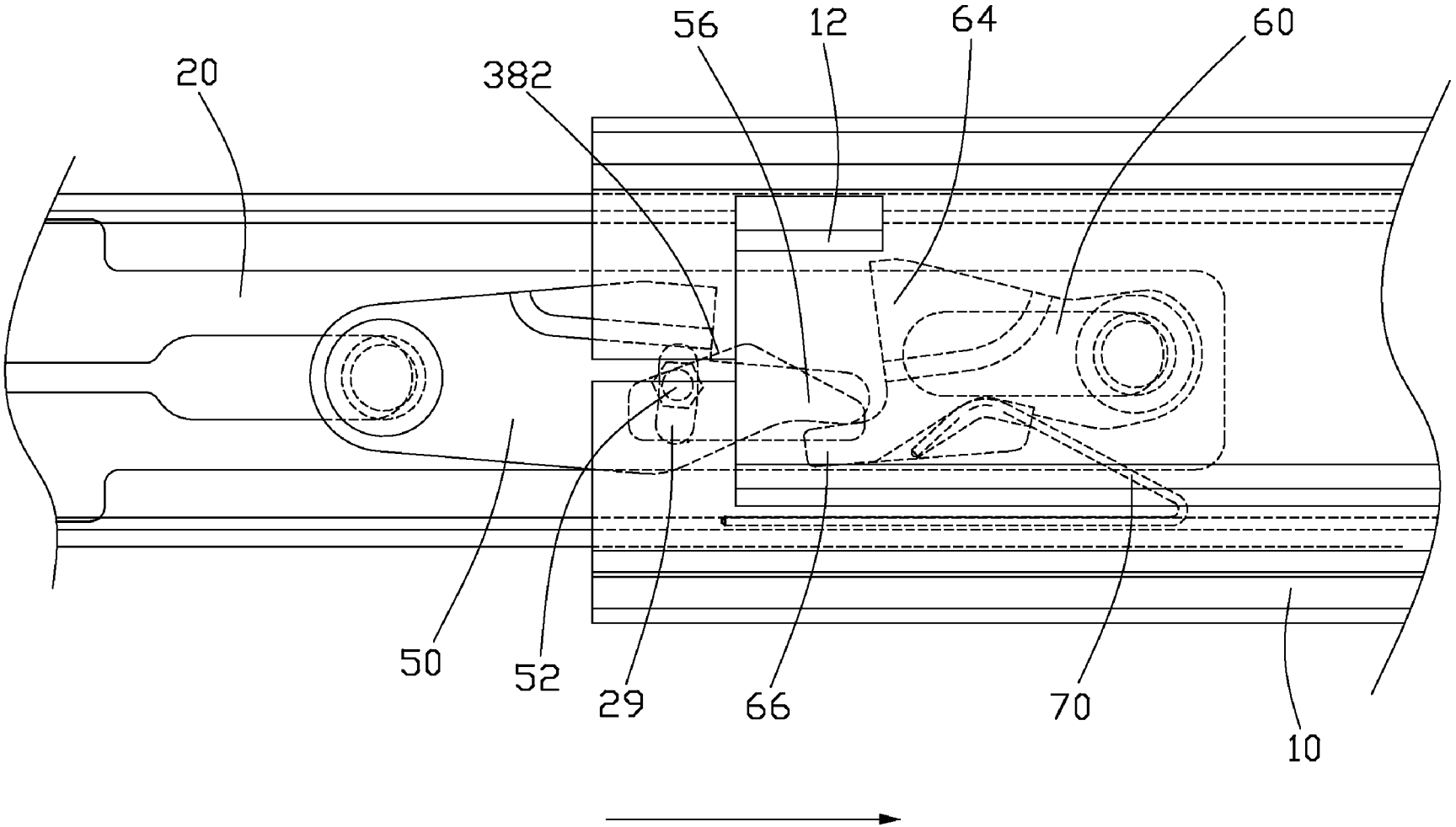

Referring also to FIGS. 5, 6, and 8, in a mode of releasing the first rail 10 from the second rail 20, the leftmost push button 40 (as viewed in the figures) can be pressed toward the second rail 20 so that the distal end thereof disengages from the corresponding tab 321 of the corresponding opening 32 of the releasing member 30. Thus, the releasing member 30 is allowed to be pushed rightward (as viewed in the figures) so that the left driving edge 382 of the triangular slot 38 of the releasing member 30 forces the post 52 of the first latch member 50 to move therealong. Consequently, the first latch member 50 is rotated. Accordingly, the driving portion 58 of the first latch member 50 presses the driven portion 66 of the second latch member 60 so that the second latch member 60 is rotated and the stop surface of the stop portion 64 of the second latch member 60 disengages from the protrusion 12 of the first rail 10. The first rail 10 can then be easily drawn away from the second rail 20. The resilient clip 70 is deformed. At the same time, the leftmost hook 35 (as viewed in the figures) of the releasing member 30 presses a left end of the coiled spring 26. Then, the releasing member 30 is released. The resilient clip 70 rebounds so that the first latch member 50 and the second latch member 60 rotate back. The coiled spring 26 rebounds so that the releasing member 30 slides leftward to its original position. The leftmost tab 321 (as viewed in the figures) contacts the distal of the leftmost resilient tab 22 again.

Figure 9:
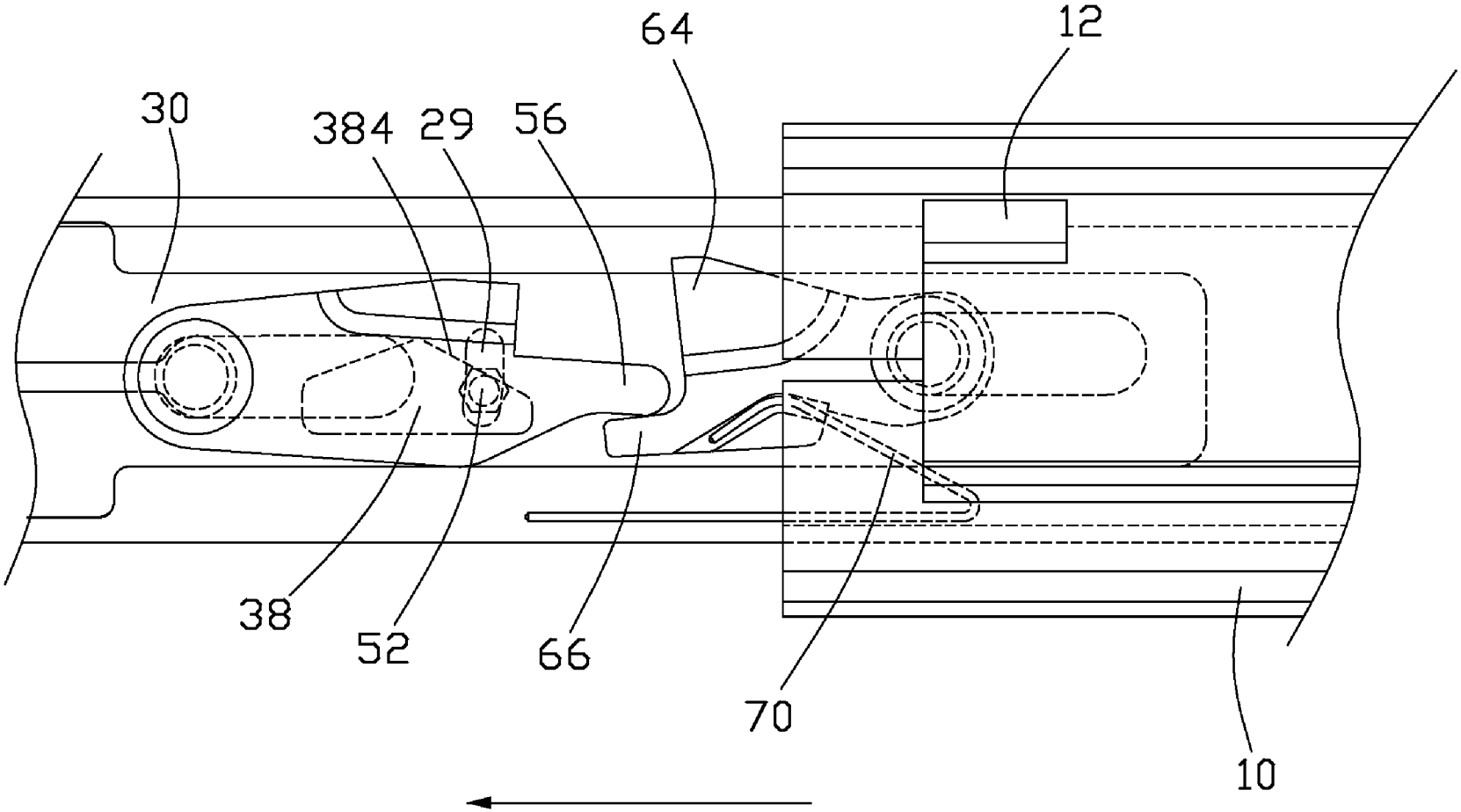

Referring also to FIGS. 5, 6, and 9, in an alternative mode of releasing the first rail 10 from the second rail 20, the right one push button 40 can be pressed toward the second rail 20 so that the distal end of the rightmost push button disengages from the corresponding tab 321 of the corresponding opening 32 of the releasing member 30. Thus, the releasing member 30 is allowed to be pushed leftward (as viewed as viewed in the figures) so that the rightmost driving edge 382 of the triangular slot 38 of the releasing member 30 forces the post 52 of the first latch member 50 to move therealong. Consequently, the first latch member 50 is rotated. Accordingly, the driving portion 58 of the first latch member 50 drives the driven portion 66 of the second latch member 60 so that the second latch member 60 is rotated and the stop surface of the stop portion 64 of the second latch member 60 disengages from the protrusion 1 2 of the first rail 10. The first rail 10 can then be easily drawn away from the second rail 20. The resilient clip 70 is deformed. At the same time, the rightmost hook 35 of the releasing member 30 presses the right end of the coiled spring 26. Then, the releasing member 30 is released. The resilient clip 70 rebounds so that the first latch member 50 and the second latch member 60 rotate back. The coiled spring 26 rebounds so that the releasing member 30 slides rightward to its original position (as viewed in the figures). The rightmost tab 321 contacts the distal end of the corresponding resilient tab 22 again.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slide rail assembly comprising:

a first rail comprising a protrusion at one end thereof; a second rail movably coupled to the first rail and comprising a pair of resilient tabs attached on a same side thereon extending opposite from each other;

a releasing member slidably attached to the second rail and comprising a pair of openings receiving a pair of push buttons therein, and a pair of angular driving edges, the resilient tabs respectively abutting against the push buttons, distal ends of the resilient tabs movably abut edges of the openings to position the releasing member; and a first and a second latch members pivotably attached to the second rail, the first latch member comprising a post selectively driven by the driving edges of the releasing member, the buttons selectively actuated to release the releasing member from the resilient tabs and moving the releasing member to drive the first latch member and the second latch member rotate to disengage the protrusion of the first rail.

2. The slide rail assembly as described in claim 1, wherein each of the push buttons comprises a main body received in the corresponding opening, and a plurality of feet extending from the main body, the releasing member comprises a plurality of apertures defined around each of the openings to receive the feet.

3. The slide rail assembly as described in claim 1, wherein the releasing member comprises a tab extending from an outside edge of each of the openings for engaging with the distal of the corresponding resilient tab.

4. The slide rail assembly as described in claim 1, further comprising a fixing board, and a spring, wherein the fixing board comprises a channel defined therein to receive the spring, and a pair of through holes defined therein beside the channel, the releasing member comprises a pair of hooks extending therefrom to selectively engage with two ends of the spring, a pair of fixing holes is defined in the second rail between the resilient tabs, a pair of key-shaped holes is defined in the releasing member, a pair of fasteners extends through the key-shaped holes and the through holes of the fixing board to engage in the fixing holes of the second rail.

5. The slide rail assembly as described in claim 1, wherein the releasing member comprises a triangular slot, the driving edges of the releasing member are two edges of the triangular slot, the second rail comprises a slanting slit defined therein, the post of the first latch member is received in the triangular slot and the slanting slit.

6. The slide rail assembly as described in claim 5, wherein the releasing member comprises a pair of grooves defined therein each beside the triangular slot, each of the first and second latch members comprises a pivoting hole defined in one end thereof, a pair of mounting holes is defined in the second rail beside the slanting slit, a pair of mounting members pivotally extends through the pivoting holes of the first and second latch members, slidably extends through the grooves of the releasing member, and engages in the mounting holes of the second rail, respectively.

7. The slide rail assembly as described in claim 6, wherein the first latch member comprises a driving portion formed at another end thereof, the second latch member comprises a driven portion formed at another end thereof and abutting the driving portion.

8. The slide rail assembly as described in claim 7, further comprising a clip, wherein the second latch member comprises a latch formed thereon, the second rail comprises a flange extending from one side thereof in a longitudinal direction, the clip comprises a pair of arms respectively retained by the latch and the flange.

9. A slide rail assembly comprising:

a first rail comprising a protrusion at one end thereof;

a second rail movably coupled to the first rail;

a positioning member pivotally attached to a releasing member to latch the protrusion of the first rail;

the releasing member slidably attached to the second rail and selectively moved in a first direction and a second direction opposite to the first direction to rotate the positioning member to disengage from the protrusion of the first rail;

a pair of resilient tabs attached to the second rail opposite to each other to prevent the releasing member moving in the first direction and the second direction; and a pair of buttons attached to the releasing member to selectively disengage the releasing member from the resilient tabs to allow the releasing member moving along the first direction or the second direction.

10. The slide rail assembly as described in claim 9, wherein the positioning member comprises a first latch member, and a second latch member pivotally driven by the first latch member.

11. The slide rail assembly as described in claim 10, wherein the releasing member comprises a triangular slot with a pair of driving edges; the first latch member comprises a post extending through the slot and selectively urged by one of the driving edges.

12. The slide rail assembly as described in claim 10, further comprising a clip, wherein the second latch member comprises a latch formed thereon, the second rail comprises a flange extending from one side thereof in a longitudinal direction, the clip comprises a pair of arms respectively retained by the latch and the flange.

13. The slide rail assembly as described in claim 9, wherein the releasing member comprises a pair of openings defined therein, and a plurality of apertures defined around each of the openings, each of the push buttons comprises a main body received in the opening, and a plurality of feet extending from the main body received in the apertures.

14. The slide rail assembly as described in claim 13, wherein the releasing member comprises a tab extending from an outside edge of each of the openings for engaging with the distal of the corresponding resilient tab.

15. The slide rail assembly as described in claim 9, further comprising a fixing board, and a spring, wherein the fixing board comprises a channel defined therein to receive the spring, and a pair of through holes defined therein beside the channel, the releasing member comprises a pair of hooks extending therefrom selectively contacting two ends of the spring, a pair of fixing holes is defined in the second rail between the resilient members, a pair of key-shaped holes is defined in the releasing member, a pair of fasteners extends through the key-shaped holes and the through holes of the fixing board to engage in the fixing holes of the second rail.

* * * * *